US006655365B2

(12) United States Patent
Beyer et al.

(10) Patent No.: US 6,655,365 B2
(45) Date of Patent: Dec. 2, 2003

(54) FUEL FILTER ASSEMBLY FOR FUEL DELIVERY MODULE

(75) Inventors: Sharon E. Beyer, Grand Blanc, MI (US); Dale R. Jones, Flushing, MI (US); Matthew Catlin, Flushing, MI (US); Ulf Sawert, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 31 days.

(21) Appl. No.: 10/118,410

(22) Filed: Apr. 8, 2002

(65) Prior Publication Data

US 2003/0188721 A1 Oct. 9, 2003

(51) Int. Cl.[7] ..... F02M 37/04
(52) U.S. Cl. ..... 123/509; 123/510
(58) Field of Search ..... 123/509, 510, 123/514; 417/360; 137/565.01, 571; 210/429, 432

(56) References Cited

U.S. PATENT DOCUMENTS 4,477,345 A * 10/1984 Szlaga, Jr. ..... 210/130
5,649,514 A 7/1997 Okada et al.
5,769,061 A 6/1998 Nagata et al.
5,782,223 A 7/1998 Yamashita et al.
5,809,975 A * 9/1998 Tuckey et al. ..... 123/509
6,106,244 A 8/2000 Nakatsukasa et al.
6,142,126 A 11/2000 Kanamaru
6,155,238 A * 12/2000 Briggs et al. ..... 123/509
6,213,143 B1 * 4/2001 Schwegler et al. .... 137/115.27
6,364,121 B1 * 4/2002 Janik et al. ..... 210/438
6,453,870 B1 * 9/2002 Koller et al. ..... 123/198 E

* cited by examiner

*Primary Examiner*—Mahmoud Gimie
(74) *Attorney, Agent, or Firm*—Jimmy L. Funke

(57) ABSTRACT

A fuel filter assembly for a fuel delivery module for a fuel system of a vehicle includes a filter housing adapted to be disposed in a fuel reservoir of the fuel delivery module and having a closed end and an open end. The fuel filter assembly also includes a fuel filter disposed in the filter housing and an end cap connected to the filter housing to close the open end. The fuel filter has an integral spring cooperating with the filter housing to urge the fuel filter toward the end cap.

18 Claims, 4 Drawing Sheets

FUEL FILTER ASSEMBLY FOR FUEL DELIVERY MODULE

TECHNICAL FIELD

The present invention relates generally to fuel systems for vehicles and, more particularly, to a fuel filter assembly for a fuel delivery module for a fuel system of a vehicle.

BACKGROUND OF THE INVENTION

It is known to provide a fuel system for a vehicle, which includes a fuel delivery module, a fuel filter, a fuel pressure regulator, a fuel rail, and fuel injectors. With the integration of the fuel filter assembly into the fuel delivery module, a need arises for higher capacity filter elements. Currently, the accepted filter element is a high capacity media, which consists of a base media of cellulose paper with a laminate of a thirty-one micron depth media. This media is then folded into a filter element and bonded to two plastic endplates via hot plate welding. The bonding of the filter element to the endplates forms an effective seal but results in an inconsistent filter element length due to the variation in melt depth of the media into the endplate. This filter element length requires that accommodations be made in the fuel filter assembly.

In the above fuel filter assemblies, the variation in filter length is accommodated for with either an extra or separate spring or added length in an o-ring interface area. However, in some instances, the addition of added length to the filter element is not an option because it adds to the installed height of the fuel delivery module.

Therefore, it is desirable to provide a new fuel filter assembly for a fuel delivery module in a fuel system for a vehicle that accommodates variations in filter length. It is also desirable to provide a fuel filter assembly for a fuel system of a vehicle that provides a spring function to the fuel filter without the addition of an extra or separate component. It is further desirable to provide a fuel filter assembly for a fuel delivery module that eliminates the potential for the filter element to rattle due to variations in filter length. Therefore, there is a need in the art to provide a fuel filter assembly for a fuel delivery module for a fuel system that meets these desires.

SUMMARY OF THE INVENTION

It is, therefore, one object of the present invention to provide a new fuel filter assembly for a fuel delivery module for a fuel system of a vehicle.

It is another object of the present invention to provide a fuel filter assembly for a fuel delivery module for a fuel system of a vehicle that accommodates variations in length of a filter element.

To achieve the foregoing objects, the present invention is a fuel filter assembly for a fuel delivery module for a fuel system of a vehicle including a filter housing adapted to be disposed in a fuel reservoir of the fuel delivery module and having a closed end and an open end. The fuel filter assembly also includes a fuel filter disposed in the filter housing and an end cap connected to the filter housing to close the open end. The fuel filter has an integral spring cooperating with the filter housing to urge the fuel filter toward the end cap.

One advantage of the present invention is that a new fuel filter assembly is provided for a fuel system of a vehicle. Another advantage of the present invention is that the fuel filter assembly integrates a plastic spring into a lower endplate for a filter element. Yet another advantage of the present invention is that the fuel filter assembly provides a spring function without the addition of an extra or separate component. Still another advantage of the present invention is that the fuel filter assembly effectively eliminates the potential for the filter element to rattle in the filter housing due to variation in length of the filter element.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
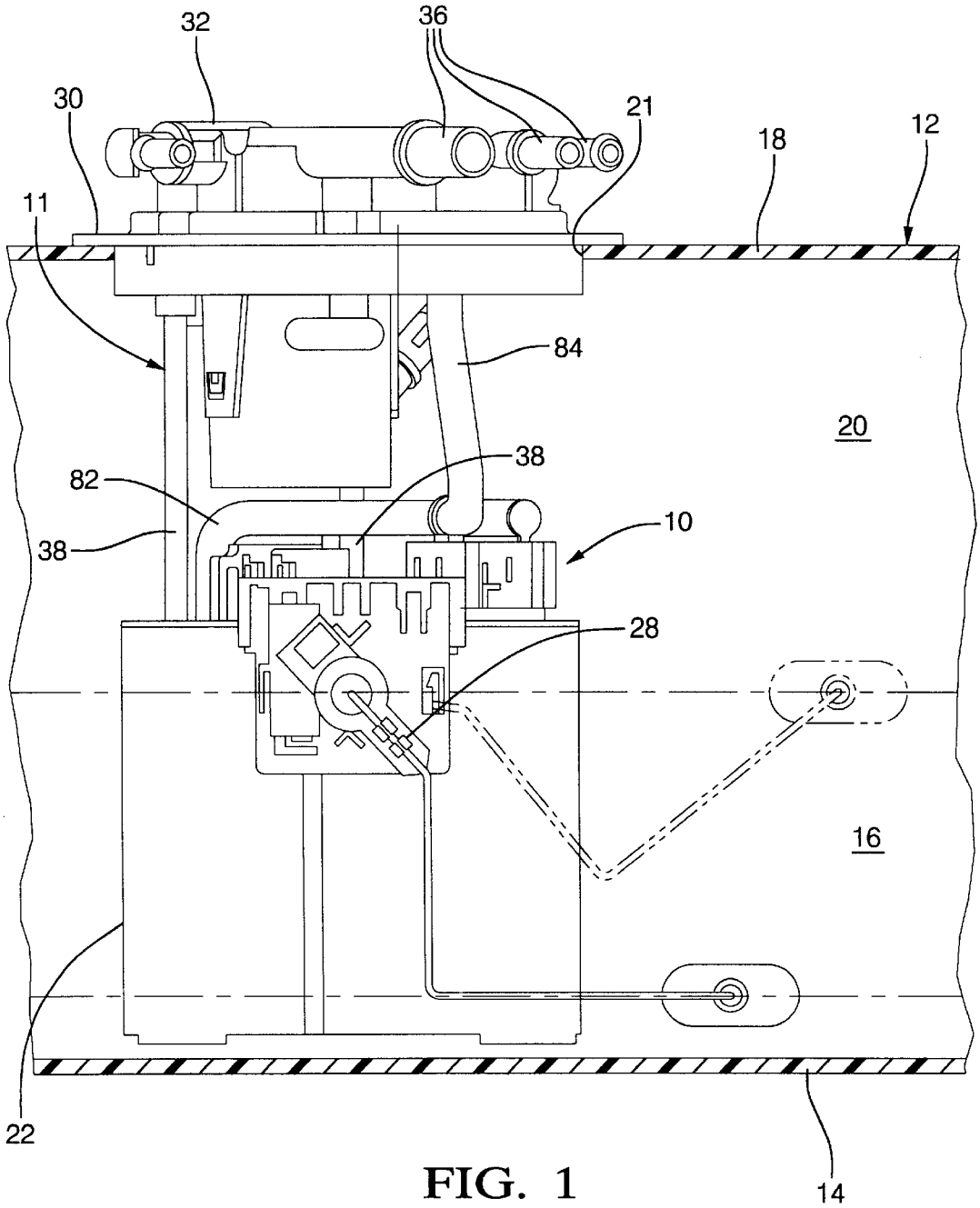
FIG. 1 is an elevational view of a fuel delivery module incorporating a fuel filter assembly, according to the present invention, illustrated in operational relationship with a fuel tank.

Referring to the drawings and in particular FIG. 1, one embodiment of a fuel filter assembly 10, according to the present invention, is shown for a fuel delivery module, generally indicated at 11, of a fuel system (not shown) of a vehicle (not shown). The fuel delivery module 11 is used with a fuel tank, generally indicated at 12, which holds liquid fuel. In this embodiment, the fuel tank 12 includes a bottom or base wall 14 and a side wall 16 around a periphery of the base wall 14 and extending generally perpendicular thereto. The fuel tank 12 also includes a top wall 18 extending generally perpendicular to the side wall 16 to form an interior chamber 20 to hold fuel. The top wall 18 includes an opening 21 therein for a function to be described. The fuel tank 12 is made of a rigid material, preferably a plastic material. It should be appreciated that the fuel tank 12 could be made of a metal material such as steel.

Figure 2:
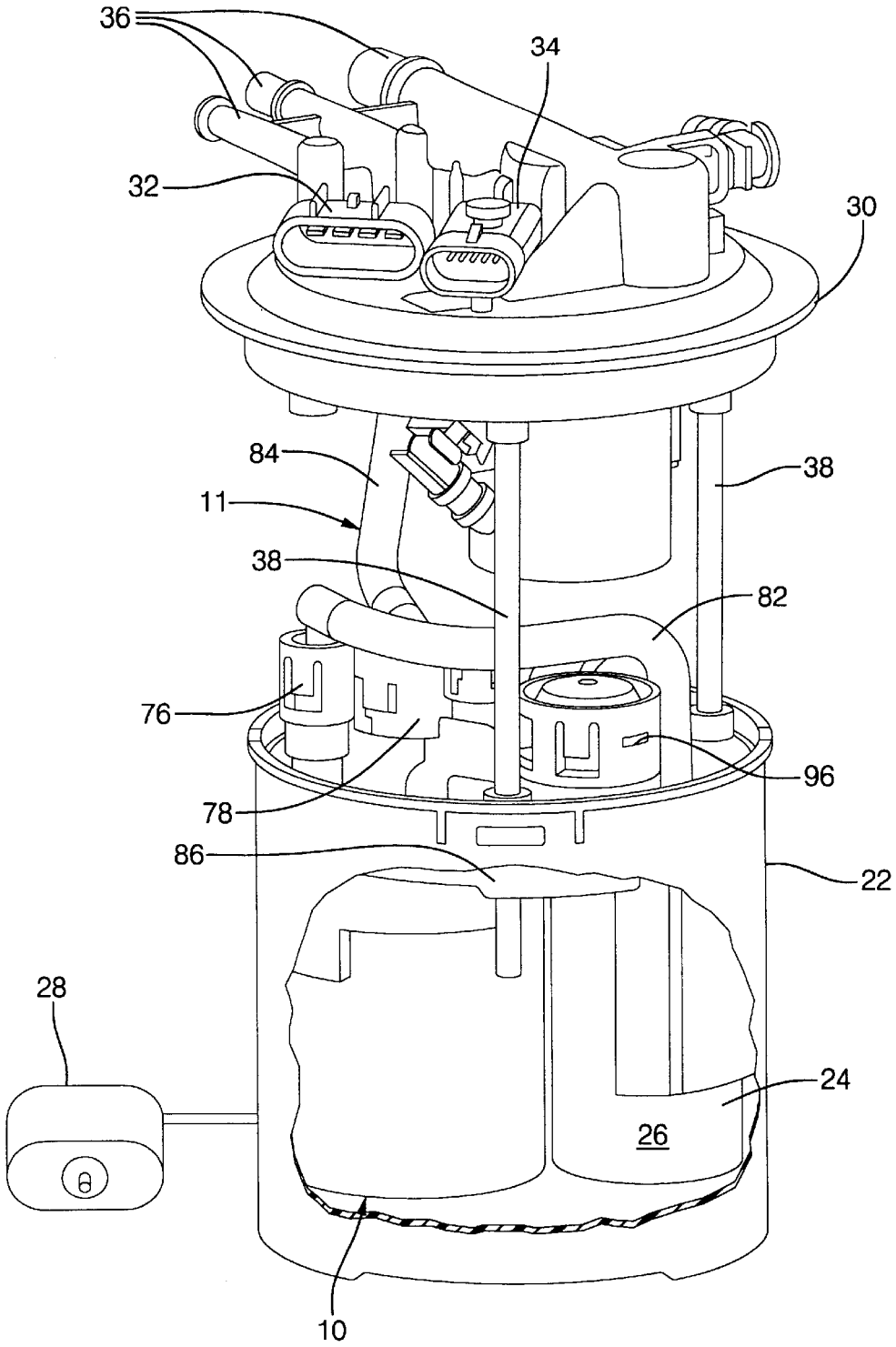
FIG. 2 is a perspective view of the fuel delivery module of FIG. 1 with a portion broken away to illustrate the fuel filter assembly.
Figure 3:
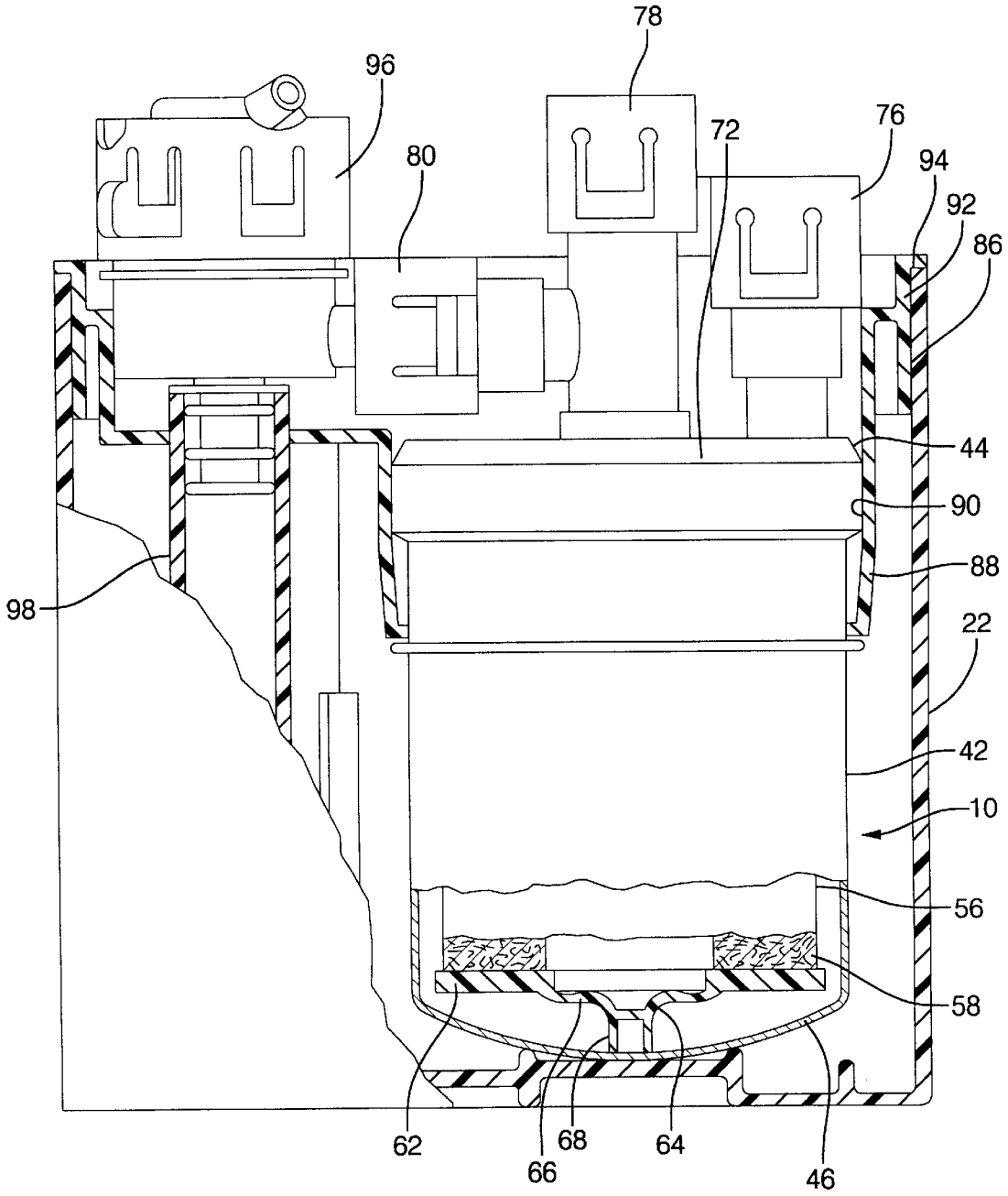
FIG. 3 is a fragmentary elevational view of the fuel filter assembly and a portion of the fuel delivery module of FIG. 2.
Figure 4:
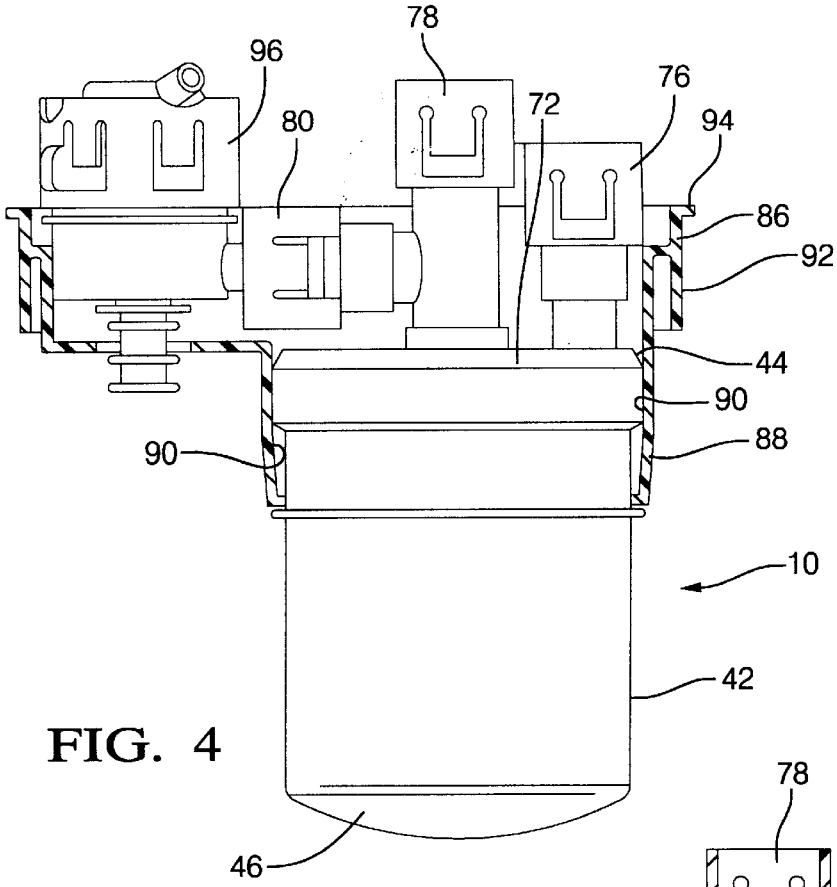
FIG. 4 is a fragmentary elevational view of the fuel filter assembly and a portion of the fuel delivery module of FIG. 2.
Figure 5:
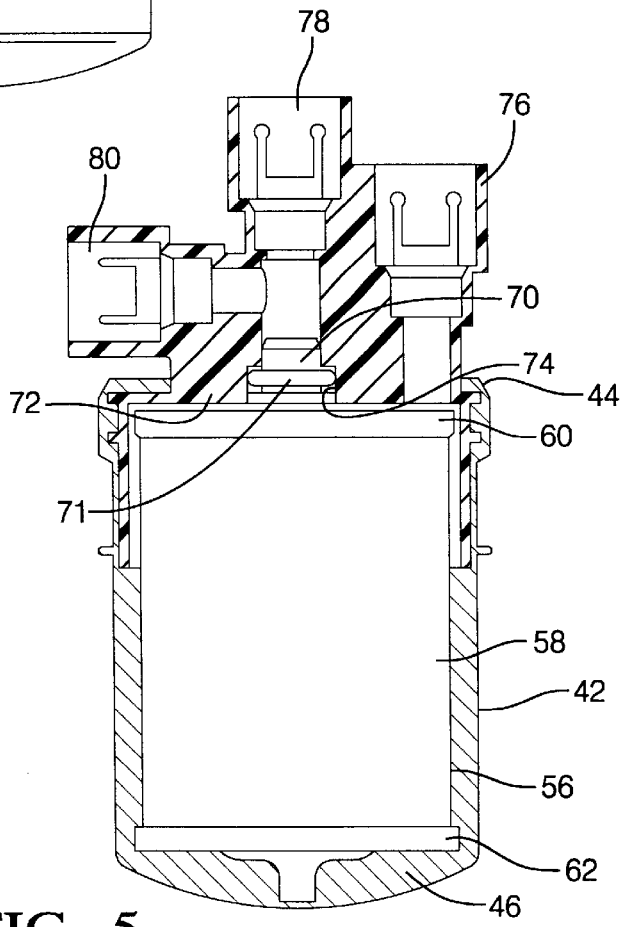
FIG. 5 is a fragmentary elevational view of the fuel filter assembly of FIG. 2.

Referring to FIGS. 1 and 2, the fuel delivery module 11 is disposed in the interior chamber 20 and delivers fuel from the fuel tank 12 to an engine (not shown) of the vehicle. The fuel delivery module 11 includes a fuel reservoir 22 having an electrical fuel pump 24 mounted therein. The fuel pump 24 has a metal shell 26 attached to an internal electrical ground (not shown) therein. The fuel delivery module 11 also includes a fuel level indication mechanism 28 such as a rheostat connected to the fuel reservoir 22 for indicating the level of the fuel inside the fuel tank 12. It should be appreciated that the fuel reservoir 22, fuel pump 24, and fuel level indication mechanism 28 are conventional and known in the art.

The fuel delivery module 11 includes a cover 30 to close the opening 21 in the fuel tank 12. The cover 30 includes an electrical connector 32 and a thermistor or onboard diagnostic sensor 34 connected to the cover 30. The cover 30 is made of a rigid material such as metal or plastic. It should be appreciated that the cover 30 has a plurality of fuel tubes connected to fuel lines (not shown).

The fuel delivery module 11 further includes a plurality of guide rods or tubes 38 to mechanically connect the cover 30 with the fuel reservoir 22. The fuel delivery module 11 includes a pump harness (not shown) electrically connected to the electrical connector 32 and the fuel pump 24. It should be appreciated that the fuel pump 24 is electrically connected to a vehicle electrical system (not shown) through the pump harness and the electrical connector 32.

Referring to FIGS. 2 through 5, the fuel delivery module 11 includes the fuel filter assembly 10, according to the present invention, disposed in the fuel reservoir 22 and cooperating with the fuel pump 24. The fuel filter assembly 10 includes a housing 42 that is generally cylindrical and circular in shape. The housing 42 has an open upper end 44 and a closed lower end 46. The housing 42 is made of a rigid material such as metal. The housing 42 is a monolithic structure being integral, unitary, and one-piece.

The fuel filter assembly 10 also includes a filter 56 disposed in the housing 42. The filter 56 is generally cylindrical and circular in shape. The filter 56 is of a cartridge style filter element. The filter 56 is made of a filter media 58 of stratapore laminates having multiple depth media layers laminated to a plain cellulose media. The filter 56 has an upper endplate 60 at an upper end of the filter media 58 and a lower endplate 62 at a lower end of the filter media 58. The upper and lower endplates 60 and 62 are generally circular in shape. The endplates 60 and 62 are made of a plastic material. The endplates 60 and 62 are bonded to the filter media 58 by conventional means such as hot plate welding.

The fuel filter assembly 10 includes a spring 64 to bias the filter 56 away from the lower end 46 of the housing 42. The spring 64 is formed on the lower endplate 62 and integral therewith. The spring 64 has a flexible portion 66 connected to the endplate 62 and a post or base portion 68 extending axially from the flexible portion 66. The spring 64 provides a spring force to load the filter 56 to an upper end cap 72 to be described. The post portion 68 is generally tubular and circular in cross-sectional shape. The spring 64 is made of a plastic material. The spring 64 and the lower endplate 62 are a monolithic structure being integral, unitary, and one-piece. It should be appreciated that the post portion 68 engages the lower end 46 of the housing 42 to flex the flexible portion 66 and urge the filter 68 upward toward an upper end cap 72 to be described.

The upper endplate 60 has a projection 70 extending axially therefrom. The projection 70 is generally tubular and circular in cross-sectional shape. The upper endplate 60 has a seal 71 such as an o-ring disposed about the projection for a function to be described.

The fuel filter assembly 10 includes an upper end cap 72 to close the upper end 44 of the housing 42. The upper end cap 72 is generally circular in shape. The upper end cap 72 has a cavity 74 extending axially therein to receive the seal 71 and projection 70. The upper end cap 72 is made of a plastic material. The upper end cap 72 is a monolithic structure being integral, unitary, and one-piece. The housing 42 is secured to the upper end cap 72 by suitable means such as crimping the housing 42 over the upper end cap 72.

The upper end cap 72 includes at least one, preferably a plurality of integral quick connectors 76, 78, and 80 extending outwardly therefrom. The quick connector 76 is fluidly connected via a conduit 82 to the fuel pump 24 as illustrated in FIG. 2. The quick connector 78 is fluidly connected via a conduit 84 to an engine (not shown) of the vehicle. The quick connector 80 is fluidly connected to a fuel pressure regulator assembly 96 to be described. It should be appreciated that the upper end cap 72 is conventional and known in the art.

The fuel delivery module 11 also includes a retainer 86 to hold the fuel filter assembly 10. The retainer 86 has a cavity wall 88 extending axially and annularly to form a cavity 90. The fuel filter assembly 10 is disposed in the cavity 90 and is snap-fitted therein by the cavity wall 88. The retainer 86 also has an annular sidewall 92 connected to the cavity wall 88. The sidewall 92 extends axially and has a flange 94 extending generally perpendicular thereto that overlaps a top edge of the reservoir 22. The retainer 86 is made of a plastic material. The retainer 86 is a monolithic structure being integral, unitary, and one-piece.

The fuel delivery module 11 may include a fuel pressure regulator assembly 96. The fuel pressure regulator assembly 96 is disposed in the retainer 86 and snap fits via the quick connector 80 to the fuel filter assembly 10. The fuel pressure regulator assembly 96 also cooperates with a by-pass fuel tube 98 extending axially through the retainer 86 from the reservoir 22. It should be appreciated that the fuel pressure regulator assembly 96 is conventional and known in the art.

In operation, the spring 64 of the fuel filter assembly 10 is compressed during assembly (crimping) of the fuel filter assembly 10. The spring 64 then acts to bias the filter 56 towards the upper end cap 72 such that the projection 70 and seal 71 of the upper endplate 60 seal in the cavity 74 of the upper end cap 72 to maintain a seal therebetween.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel filter assembly for a fuel delivery module of a fuel system of a vehicle comprising:

a filter housing adapted to be disposed in a fuel reservoir of the fuel delivery module and having a closed end and an open end;

a fuel filter disposed in said filter housing;

an end cap connected to said filter housing to close said open end; and said fuel filter having an integral spring cooperating with said filter housing to urge said fuel filter toward said end cap.

2. A fuel filter assembly as set forth in claim 1 wherein said fuel filter comprises a filter media, an upper endplate at an upper end of said filter media, and a lower endplate at a lower end of said filter media.

3. A fuel filter assembly as set forth in claim 2 wherein said upper endplate has a projection extending axially therefrom.

4. A fuel filter assembly as set forth in claim 3 wherein said end cap includes a cavity to receive said projection and a seal disposed about said projection and in said cavity.

5. A fuel filter assembly as set forth in claim 2 wherein said spring extends from said lower endplate.

6. A fuel filter assembly as set forth in claim 5 wherein said spring has a flexible portion extending radially and a post portion extending axially from said post portion.

7. A fuel filter assembly as set forth in claim 2 wherein said lower endplate is made of a plastic material.

8. A fuel filter assembly as set forth in claim 7 wherein said spring is made of a plastic material.

9. A fuel filter assembly as set forth in claim 8 wherein said lower endplate and said spring are unitary and formed as one-piece.

10. A fuel delivery module comprising:

a fuel reservoir adapted to be disposed in an interior chamber of a fuel tank;

a fuel pump disposed in said fuel reservoir and adapted to pump fuel from the fuel tank to an engine of a vehicle;

a fuel filter assembly disposed in said fuel reservoir and fluidly connected to said fuel pump; and said fuel filter assembly having a filter housing with a closed end and an open end, a fuel filter disposed in said filter housing, an end cap closing said open end of said housing, and an integral spring on said fuel filter for cooperating with said filter housing to urge said fuel filter toward said end cap.

11. A fuel delivery module as set forth in claim 10 wherein said fuel filter comprises a filter media, an upper endplate at an upper end of said filter media, and a lower endplate at a lower end of said filter media.

12. A fuel delivery module as set forth in claim 11 wherein said upper endplate has a projection extending axially therefrom.

13. A fuel delivery module as set forth in claim 12 wherein said end cap includes a cavity to receive said projection and a seal disposed about said projection and in said cavity.

14. A fuel delivery module as set forth in claim 11 wherein said spring extends from said lower endplate.

15. A fuel delivery module as set forth in claim 14 wherein said spring has a flexible portion extending radially and a post portion extending axially from said flexible portion.

16. A fuel delivery module as set forth in claim 11 wherein said spring is made of a plastic material.

17. A fuel delivery module as set forth in claim 16 wherein said lower endplate and said spring are unitary and formed as one-piece.

18. A fuel system for a vehicle comprising:

a fuel tank having an interior chamber and an opening therein;

a fuel reservoir disposed in said interior chamber of said fuel tank;

a fuel pump disposed in said fuel reservoir to pump fuel therefrom to an engine of the vehicle;

a fuel filter assembly disposed in said fuel reservoir; and said fuel filter assembly comprising a filter housing having a closed end and an open end, a fuel filter disposed in said filter housing, an end cap closing said open end of said filter housing, and said fuel filter having an integral spring cooperating with said filter housing to urge said fuel filter toward said end cap.

* * * * *